US005966077A

United States Patent [19]

Wong

[11] Patent Number: 5,966,077

[45] **Date of Patent: *Oct. 12, 1999**

[54] FIRE DETECTOR

[75] Inventor: Jacob Y. Wong, Santa Barbara, Calif.

[73] Assignee: Engelhard Sensor Technologies Inc., Goleta, Calif.

[ * ] Notice: This patent is subject to a terminal disclaimer.

[21] Appl. No.: 09/060,115

[22] Filed: Apr. 14, 1998

Related U.S. Application Data

[63] Continuation of application No. 08/593,253, Jan. 29, 1996, Pat. No. 5,767,776, which is a continuation of application No. 08/593,750, Jan. 29, 1996, Pat. No. 5,691,704.

[51] Int. Cl.[6] ..... G08B 17/10

[52] U.S. Cl. ..... 340/630; 340/522; 340/578; 340/587; 340/632; 250/343

[58] Field of Search ..... 340/522, 528, 340/577, 578, 579, 587, 628, 632, 630; 250/343, 339.03, 339.15

[56] References Cited

U.S. PATENT DOCUMENTS

| | | | |
|---|---|---|---|
| 5,691,704 | 11/1997 | Wong | 340/628 |
| 5,767,776 | 6/1998 | Wong | 340/628 |
| 5,798,700 | 8/1998 | Wong | 340/628 |

*Primary Examiner*—Daniel J. Wu
*Attorney, Agent, or Firm*—Lyon & Lyon LLP

[57] ABSTRACT

A fire detector with a maximum average response time of less than 1.5 minutes is obtained by combining a smoke detector with a $CO_2$ detector that uses NDIR sensor technology. The smoke detector is used to detect smoldering fires and to help prevent false alarms attributable to the $CO_2$ detector. The $CO_2$ detector is used to rapidly detect fires by measuring the rate of change of $CO_2$ concentration. A signal processor generates an alarm signal when a smoldering fire is detected or alarm logic indicates that a fire has been detected.

28 Claims, 2 Drawing Sheets

FIRE DETECTOR

RELATED PATENT APPLICATION

This application is a continuation of Ser. No. 08/593,253, filed Jan. 29, 1996, now U.S. Pat. No. 5,767,776, issued Jun. 16, 1998, which is related to Ser. No. 08/593,750, filed Jan. 29, 1996, now U.S. Pat. No. 5,691,704, issued Nov. 25, 1997, the disclosure of which is specifically incorporated herein by reference. U.S. Pat. No. 5,691,704 discloses particularly preferred fire detectors that can be used to practice the present invention.

FIELD OF THE INVENTION

The present invention is in the field of early warning devices for fire detection.

BACKGROUND OF THE INVENTION

Fire detectors that are available commercially today can generally be classified within three basic classifications—flame sensing, thermal and smoke detectors. This classification is designed to respond to three principal types of energy and matter characteristics of a fire environment: flame, heat and smoke.

The flame sensing detector is designed to respond to the optical radiant energy generated by the diffusion flame combustion process—the illumination intensity and the frequency of flame modulation. Two types of flame detectors are commonly in use: the ultraviolet (UV) detectors which operate beyond the visible at wavelengths below 4,000 A and the infrared detectors which operate in the wavelengths above 7,000 A. To prevent false signals from the many sources of ultraviolet and infrared optical radiation present in most hazard areas, the detectors are programmed to respond only to radiation with frequency modulation within the flicker frequency range for flame (5–30 Hz).

Flame detectors generally work well and seldom generate false alarms. However, they are relatively complex and expensive fire detectors which are not amenable to low-cost and mass-oriented usage. Instead they are mostly utilized in specialized high-value and unique protection areas such as aircraft flight simulators, aircraft hangars, nuclear reactor control rooms, etc.

Thermal detectors are designed to operate from thermal energy output—the heat—of a fire. This heat is dissipated throughout the area by laminar and turbulent convection flow. The latter is induced and regulated by the fire plume thermal column effect of rising heated air and gases above the fire surface. There are two basic types of thermal detectors: the fixed temperature type and the rate-of-rise detector type. The fixed temperature type further divides into the spot type and the line type. The spot detector involves a relatively small fixed unit with a heat-responsive element contained within the unit or spot location of the detector. With the line detector the thermal reactive element is located along a line consisting of thermal-sensitive wiring or tubing. Line detectors can cover a greater portion of the hazard area than can spot detectors.

Fixed temperature thermal fire detectors rate high on reliability but low on sensitivity. In modem buildings with high air flow ventilation and air conditioning systems, placing the fixed temperature detector is a difficult engineering problem. Consequently, this type of thermal fire detector is not widely used outside of very specialized applications.

A rate-of-rise detector type thermal fire detector is usually installed where a relatively fast-burning fire is expected. The detector operates when the fire plume raises the air temperature within a chamber at a rate above a certain threshold of operation—usually 15° F. per minute. However, if a fire develops very slowly and the rate of temperature rise never exceeds the detector's threshold for operation, the detector may not sense the fire.

A newer type of fire detector is called rate-compensated detector which is sensitive to the rate of temperature rise as well as to a fixed temperature level which is designed into the detector's temperature rating. Even with this dual approach, the most critical problem for effective operation of thermal fire detectors is the proper placement of detectors relative to the hazard area and the occupancy environment. Consequently, this type of fire detector is seldom found in everyday households.

By far the most popular fire detector in use in everyday life today is the smoke detector. Smoke detectors respond to the visible and invisible products of combustion. Visible products of combustion consist primarily of unconsumed carbon and carbon-rich particles; invisible products of combustion consist of solid particles smaller than approximately five (5) microns, various gases, and ions. All smoke detectors can be classified into two basic types: Photoelectric type which responds to visible products of combustion and ionization type which responds to both visible and invisible products of combustion.

The photoelectric type is further divided into 1) projected beam and 2) reflected beam. The projected beam type of smoke detectors generally contain a series of sampling piping connected to the photoelectric detector. The air sample is drawn into the piping system by an electric exhaust pump. The photoelectric detector is usually enclosed in a metal tube with the light source mounted at one end and the photoelectric cell at the other end. This type of detector is rather effective due to the length of the light beam. When visible smoke is drawn into the tube, the light intensity of the beam received in the photoelectric cell is reduced because it is obscured by the smoke particles. The reduced level of light intensity causes an unbalanced condition in the electrical circuit to the photocell which activates the alarm. The projected beam or smoke obscuration detector is one of the most established types of smoke detectors. In addition to use on ships, these detectors are commonly used to protect high-value compartments of other storage areas, and to provide smoke detection for plenum areas and air ducts.

The reflected light beam smoke detector has the advantage of a very short light beam length, making it adaptable to incorporation in the spot type smoke detector. The projected beam smoke detector discussed earlier becomes more sensitive as the length of the light beam increases, and often a light beam of 5 or 10 feet long is required. However, the reflected light beam type of a photoelectric smoke detector is designed to operate with a light beam only 2 or 3 inches in length. A reflected beam visible light smoke detector contains a light source, a photoelectric cell mounted at right angles to the light source, and a light catcher mounted opposite to the light source.

Ionization type smoke detectors detect both the visible and invisible particle matter generated by the diffusion flame combustion. As indicated previously, visible particulate matter ranges from 4 to 5 microns in size, although smaller particles can be seen as a haze when present in a high mass density. The ionization detector operates most effectively on particles from 1.0 to 0.01 microns in size. There are two basic types of ionization detectors. The first type has a bipolar ionized sampling chamber which is the area formed between two electrodes. A radioactive alpha particle source is also located in this area. The oxygen and nitrogen molecules of air in the chamber are ionized by alpha particles from the radioactive source. The ionized pairs move towards the electrodes of the opposite signs when electrical voltage is applied, and a minute electrical current flow is established across the sampling chamber. when combustion particles enter the chamber they attach themselves to the ions. Since the combustion particles have a greater mass, the mobility of the ions now decreases, leading to a reduction of electrical current flow across the sampling chamber. This reduction in electrical current flow initiates the detector alarm.

The second type of ionization smoke detector has a unipolar ionized sampling chamber instead of a bipolar one. The only difference between the two types is the location of the area inside the sampling chamber that is exposed to the alpha source. In the case of the bipolar type the entire chamber is exposed leading to both positive and negative ions (hence the name bipolar). In the case of the unipolar type only the immediate area adjacent the positive electrode (anode) is exposed to the alpha source. This results in only one predominant type of ions (negative ions) in the electrical current flow between the electrodes (hence the name unipolar).

Although unipolar and bipolar sampling chambers use different principles of detector design, they both operate by the combustion products creating a reduced current flow and thus activating the detector. In general, the unipolar design is superior in giving the ionization smoke detectors a greater level of sensitivity and stability, with fewer fluctuations of current flow to cause false signals from variations in temperature, pressure and humidity. Most ionization smoke detectors available commercially today are of the unipolar type.

For the past two decades the ionization smoke detectors have dominated the fire detector market. One of the reasons is that the other two classes of fire detectors, namely the flame sensing detectors and the thermal detectors, are appreciably more complex and costlier than the ionization smoke detectors. They are therefore mainly used only in specialized high-value and unique protection areas. In recent years, because of their relatively high cost, even the photoelectric smoke detectors have significantly fallen behind in sales to the ionization type. The ionization types are generally less expensive, easier to use and can usually operate for a full year with just one 9-volt battery. Today over 90 percent of households that are equipped with fire detectors use the ionization type smoke detectors.

Despite their low cost, relatively maintenance-free operation and wide acceptance by the buying public, the smoke detectors are not without problems and certainly far from being ideal. There are a number of significant drawbacks for the ionization smoke detectors to operate successfully as early warning fire detectors.

One drawback to smoke detectors is the importance of placement of the detector with respect to the spot where fire breaks out. Unlike ordinary gases, smoke is actually a complex sooty molecular cluster that consists mostly of carbon. It is much heavier than air and thus diffuses much slower than the gases we encounter everyday. Therefore, if the detector happens to be at some distance from the location of the fire, it will be a while before enough smoke gets into the sampling chamber of the smoke detector to trigger the alarm. Another drawback is the nature or type of fire itself. Although smoke usually accompanies fire, the amount produced can vary significantly depending upon the composition of the material that catches fire. For example oxygenated fuel such as ethyl alcohol and acetone give less smoke than the hydrocarbons from which they are derived. Thus under free burning conditions oxygenated fuels such as wood and polymethylmethacrylate give substantially less smoke than hydrocarbon polymers such as polyethylene and polystyrene. As a matter of fact, a small number of pure fuels, namely carbon monoxide, formaldehyde, metaldehyde, formic acid and methyl alcohol, burn with non-luminous flames and do not produce smoke at all.

However, one of the biggest problems with ionization smoke detectors is their frequent false-alarms. By the nature of its operational principle, any micron-size particulate matter other than the smoke from an actual fire can set off the alarm. Kitchen grease particles generated by a hot stove is one classic example. Over-zealous dusting of objects and/or furniture near the detector is another. Frequent false-alarms are not just a harmless nuisance; people may disarm their smoke detectors by temporarily removing the battery in order to escape from such annoying episodes. This latter situation could be outright dangerous especially when such people forget to re-arm their smoke detectors by replacing the battery.

In order to lessen the problems associated with false alarms in ionization smoke detectors, such detectors are normally set to sound an alarm at a smoke detection threshold level that is higher than that which is required to detect a fire. By increasing the detection threshold, fewer false alarms will be triggered. Unfortunately, this reduction in false alarms does not come without cost. Because the detection threshold is increased, it takes longer for the smoke detector to sound an alarm during an actual fire. In other words, the response time of the device is increased in order to decrease false alarms. The competing considerations of preventing false alarms and minimizing the response time of ionization smoke detectors are balanced in industry standards that have been adopted to promote safety and establish reliability and performance characteristics for smoke detectors.

The present standard for common household fire detectors in the United States is UL217 Standard for Single and Multiple Station Smoke Detectors (Third Edition) that has been approved as an American National Standard and is hereinafter referred to as ANSI/UL 217—1985, Mar. 22, 1985, the disclosure of which is specifically incorporated herein by reference. ANSI/UL 217—1985, Mar. 22, 1985 covers (1) electrically operated single and multiple station smoke detectors intended for open area protection in ordinary indoor locations of residential units in accordance with the Standard for Household Fire Warning Equipment, NFPA 74, (2) smoke detectors intended for use in recreational vehicles in accordance with Standard for Recreational Vehicles, NFPA 501C, and (3) portable smoke detectors used as "travel" alarms.

Recognizing that different types of fires have different characteristics, ANSI/UL 217—1985, Mar. 22, 1985 contains four different fire tests—tests for paper fires, wood fires, gasoline fires and polystyrene fires. The procedure for performing tests characteristic of each of these fires is set forth in paragraph 42 of ANSI/UL 217—1985, Mar. 22, 1985. According to paragraph 42.1 of ANSI/UL 217—1985, Mar. 22, 1985, the maximum response time for an approved fire detector is four minutes for paper and wood fire tests, three minutes for a gasoline fire test and two minutes for a polystyrene fire test. Because the highest maximum response time is four minutes, it is common to refer to a maximum response time for a household fire detector of four minutes without reference to the paper or wood fire tests. Although ionization flame detectors sold for household use could be set to have a lower response time than four minutes, most household detectors have a maximum response time of four minutes or just under four minutes to minimize the risk of false alarms.

Thus, an inherent limitation of commercially available ionization smoke detectors is a response time that is not optimized. Because the response time of a fire detector can be critical to saving lives and fighting fires, any improvement in response time, assuming that it does not increase the risk of false alarms or come at a prohibitive cost, would represent a significant advance in the art of fire detection and help satisfy a long-felt need for improved fire detectors that save additional lives and property.

In an attempt to provide such an advance, efforts have been made to develop a new type of fire detector. In this regard, it has been known for a long time that as a process, fire can take many forms, all of which however involve chemical reaction between combustible species and oxygen from the air. In other words, fire initiation is necessarily an oxidation process since it invariably involves the consumption of oxygen at the beginning. The most effective way to detect fire initiation, therefore, is to look for and detect end products of the oxidation process. With the exception of a few very specialized chemical fires (i.e., fires involving chemicals other than the commonly encountered hydrocarbons), there are three elemental entities (carbon, oxygen and hydrogen) and three compounds (carbon dioxide ("$CO_2$"), carbon monoxide and water vapor) that are invariably involved in the ensuing chemical reactions or combustion of a fire.

Of the three effluent gases that are generated at the onset of a fire, $CO_2$ is the best candidate for detection by a fire detector. This is because water vapor is a very difficult gas to measure since it tends to condense easily on every available surface causing its concentration to fluctuate wildly dependent upon the environment. Carbon monoxide, on the other hand, is invariably generated in a lesser quantity than $CO_2$, especially at the beginning of a fire. It is only when the fire temperature gets to 600° C. or above that more of it is produced at the expense of $CO_2$ and carbon. Even then more $CO_2$ is produced than carbon monoxide according to numerous studies of fire atmospheres in the past. In addition to being generated abundantly right from the start of the fire, $CO_2$ is a very stable gas.

Although it has been known in theory for many years that detection of $CO_2$ should provide an alternative way to detect fires, $CO_2$ detectors have not yet found wide use as fire detectors due to their cost and general unsuitability for use as fire detectors. In the past, $CO_2$ detectors have traditionally been infrared detectors that have suffered drawbacks related to cost, moving parts or false alarms. However, recent advances in the field of Non-Dispersive Infrared (NDIR) techniques have opened up the possibility of a viable $CO_2$ detector that can be used to detect fires.

In U.S. Pat. No. 5,053,754 by Jacob Y. Wong entitled Simple Fire Detector, a fire detector using NDIR techniques is proposed. 4.26$\mu$ light is directed through a sample of room air to measure the concentration of $CO_2$ in this air, because $CO_2$ has a strong absorption peak at this wavelength. Both the concentration and the rate of change of concentration of the $CO_2$ are measured, enabling an alarm to be generated whenever either of these measured values exceeds a respective threshold value. Preferably, an alarm is sounded only if both of these values exceeds its respective threshold value.

In U.S. Pat. No. 5,079,422 by Jacob Y. Wong entitled Fire Detection System using Spatially Cooperative Multi-Sensor input Technique, a set of N sensors are spaced throughout a large room or unpartitioned building. Comparison of data from different sensors provides information that is unavailable from only a single sensor. The data from each of these sensors and/or the rate of change of such data is used to determine whether a fire has occurred. The use of data from more than one sensor reduces the likelihood of a false alarm.

In U.S. Pat. No. 5,103,096 by Jacob Y. Wong entitled Rapid Fire Detector, a black body source produces a light that is directed through a filter that transmits light in two narrow bands at the 4.26 micron absorption band of $CO_2$ and at 2.20 microns at which none of the atmospheric gases has an absorption band. A blackbody source is alternated between two fixed temperatures to produce light directed through ambient gas and through a filter that passes only these two wavelengths of light. In order to avoid false alarms, an alarm is generated only when both the magnitude of the ratio of the measured intensities of these two wavelengths of light and the rate of change of this ratio are both exceeded.

In U.S. Pat. No. 5,369,397 by Jacob Y. Wong entitled Adaptive Fire Detector, a fire detector that includes a $CO_2$ sensor and a microcomputer is disclosed that can alter the threshold detection level for $CO_2$ before an alarm is sounded to compensate for variations in the background concentration of $CO_2$.

Since virtually all fires generate $CO_2$, $CO_2$ detectors should be able to be used as fire detectors. However, there are two practical limitations that have to be dealt with in designing a fire detector that uses a $CO_2$ detector.

First, although fires generate copious amount of $CO_2$, there is one other commonly encountered source, albeit relatively weaker, namely from people, that also has to be taken into account. Because of this, the concentration level and rate of increase thresholds for alarm for $CO_2$ sensors used as fire detectors cannot be set arbitrarily low. Otherwise $CO_2$ generation by the presence of people in an enclosed space might be misinterpreted as a real fire. In practice, the rate of $CO_2$ generation by a typical fire can exceed that of human presence by several orders of magnitude. Thus this limitation does not impair in any significant way the speed of response to the onset of real fires by $CO_2$ fire detectors.

Second, because of the fact that $CO_2$ concentration level and rate of increase thresholds cannot be set arbitrarily low because of human presence, as discussed above, fires that generate very small amounts of $CO_2$, such as some types of smoldering fires, cannot be optimally detected in terms of speed of response by $CO_2$ fire detectors.

The deficiencies of present day smoke detectors can be substantially and effectively overcome in accordance with the present invention by the union of a smoke detector and a $CO_2$ sensor. By combining a conventional smoke detector (photoelectric or ionization) with a $CO_2$ detector into a new "dual" fire detector, it is possible to eliminate most commonly encountered false alarms. Furthermore, this "dual" fire detector is also significantly faster for detecting all types of fires, from the slow moving smoldering kinds to the almost smoke-free fast moving varieties.

Contrary to the common practice of increasing the sensitivity, or lowering the obscuration detection threshold, of a smoke detector, in order to speed up its fire detection response, but invariably decreasing its false alarm immunity, the new "dual" fire detector uses $CO_2$ as an additional input to minimize false alarms.

This additional input functions as a "flag" or a status switch for the new "dual" fire detector. When the $CO_2$ detector of this "dual" fire detector senses a pre-selected high level of $CO_2$ (e.g. 3,000 ppm) and/or a pre-selected high rate of increase $CO_2$, (e.g. 200 ppm/min.) the status switch is set positive or "Ready to Go". Once this "flag" is set ready to go, the "dual" fire detector can use its low light obscuration alarm threshold for smoke (which theoretically could be as low as the smoke detector would allow, typically a few tenths of a percent) to enunciate the onset of a fire with minimum delay, while still minimizing the possibility of false alarms.

On the other hand, if the "flag" has not been set, the "dual" fire detector will not sound an alarm even if the normal light obscuration alarm threshold is reached or exceeded. During this normal alarm-sounding smoke condition, it waits for the "flag" to go positive before it enunciates the onset of the fire. This explains how most of the false alarm conditions, whose obscuration time period is usually much shorter than real fires such as the smoldering types, can be neutralized and thereby render the "dual" fire detector virtually false alarm resistant.

In order to safeguard against the occurrence of smoldering fires, the "dual" fire detector will sound an alarm if the smoke obscuration reaches a normal preset threshold such as that mandated by ANSI/UL 217—1985, Mar. 22, 1985 for a predetermined period of time of up to an hour. Since most common household false alarm episodes such as blowing dust or debris, bathroom steam or kitchen oil vapors etc. last at best a few minutes, this provision of alarm sounding ability by the "dual" fire detector will at least equal that for the conventional smoke detector. However, it is faster than the conventional smoke detector to enunciate a smoldering fire since it also detects the $CO_2$ level and/or rate of increase thresholds. Once the $CO_2$ "flag" is detected to be set or ready to go, it will immediately sound the alarm and does not have to wait for the maximum period of up to an hour to do so.

Another aspect of the "dual" fire detector takes full advantage of the fact that certain types of fast moving fires generate a tremendous amount of $CO_2$ but a relatively small amount of smoke. Thus for these types of fires, the "dual" fire detector will quickly sound the alarm when the rate of $CO_2$ increase exceeds an abnormally high threshold such as 1,000 ppm/min. irrespective of whether or not any smoke obscuration had been reached. This particular fire enunciation capability of the "dual" detector for fast moving fires is new and unique of the present invention and has never been realized nor implemented by presently available fire detectors to date.

While the $CO_2$ detector side of the "dual" fire detector could either use the concentration level and/or the rate of increase as a threshold condition to set the "flag", the rate of increase alone suffices and such a carbon dioxide detector can be implemented in the simplest and lowest cost fashion. Accordingly, detecting all types of fires including the smoldering kind with shorter response time, virtually false alarm resistant and without prohibitively increasing cost, would represent a significant advance in the art of fire detectors that could save lives and reduce property damage caused by fires.

SUMMARY OF THE INVENTION

The present invention is generally directed to an improved fire detector with a reduced maximum response time that detects common types of fires, including smoldering and fast moving varieties, while still minimizing false alarms through the combination of a smoke detector and a $CO_2$ detector.

In a first, separate aspect of the present invention, a smoke detector is used to detect smoldering fires when light obscuration exceeds a threshold level for longer than a first preselected response time or when light obsucration exceeds a reduced threshold level for longer than a second preselected time. If either of these conditions occurs, an alarm signal is generated in response to a smoldering fire. In addition, a $CO_2$ detector is used to rapidly detect fires by monitoring the rate of increase in the concentration of $CO_2$. When the rate of increase in the concentration of $CO_2$ exceeds a first predetermined rate and light obscuration exceeds a reduced threshold level or when the rate of increase in the concentration of $CO_2$ exceeds a second predetermined rate, an alarm signal is generated. An alarm signal generator generates an alarm signal in response to a smoldering fire or a non-smoldering fire based upon measurements of the smoke detector and the $CO_2$ detector. The maximum response time of the fire detector is lowered by relying upon the decreased maximum response time of the $CO_2$ detector. False alarms attributable to the $CO_2$ detector are avoided by alarm logic which responds to the detecting output of both the smoke detector and the $CO_2$ detector.

In another, separate aspect of the present invention, a fire detector is disclosed that will meet ANSI/UL 217—1985, Mar. 22, 1985 and also trigger an alarm within a maximum average response time of approximately 1.5 minutes when subjected to Tests A–D described in paragraphs 42.3–42.6 of ANSI/UL 217—1985, Mar. 22, 1985.

Accordingly, it is a primary object of the present invention to provide an improved fire detector with a reduced maximum response time while still minimizing false alarms.

This and further objects and advantages will be apparent to those skilled in the art in connection with the drawings and the detailed description of the preferred embodiment set forth below.

DETAILED DESCRIPTION OF THE PREFERRED EMBODIMENT

Figure 2:
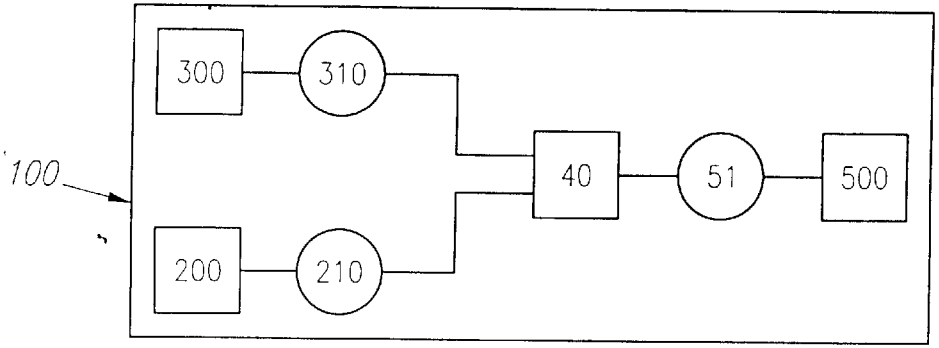
FIG. 2 is a block diagram for the preferred embodiment of the present invention.

In the preferred embodiment of the present invention shown in FIG. 2, fire detector 100 combines a smoke detector 300 with a $CO_2$ detector 200 and the detection outputs of the smoke detector and the $CO_2$ detector are fed to a signal processor 40 to determine whether an alarm signal 51 should be generated and sent to alarm 500. The $CO_2$ detector 200 generates an output signal 210 respresentative of $CO_2$ rate of increase in accordance with known principles of NDIR gas sensor technology. The smoke detector 300 generates a smoke detector output signal 310 representative of light obscuration in accordance with known principles of smoke detector technology. The signal processor 40 uses alarm logic to determine whether alarm signal 51 should be generated. Although it is preferred that a single signal processor 40 be used, multiple signal processors can be used; alternatively, portions of the alarm logic used to determine if an alarm signal 51 should be generated can be implemented as part of smoke detector 300 or $CO_2$ detector 200.

Figure 1:
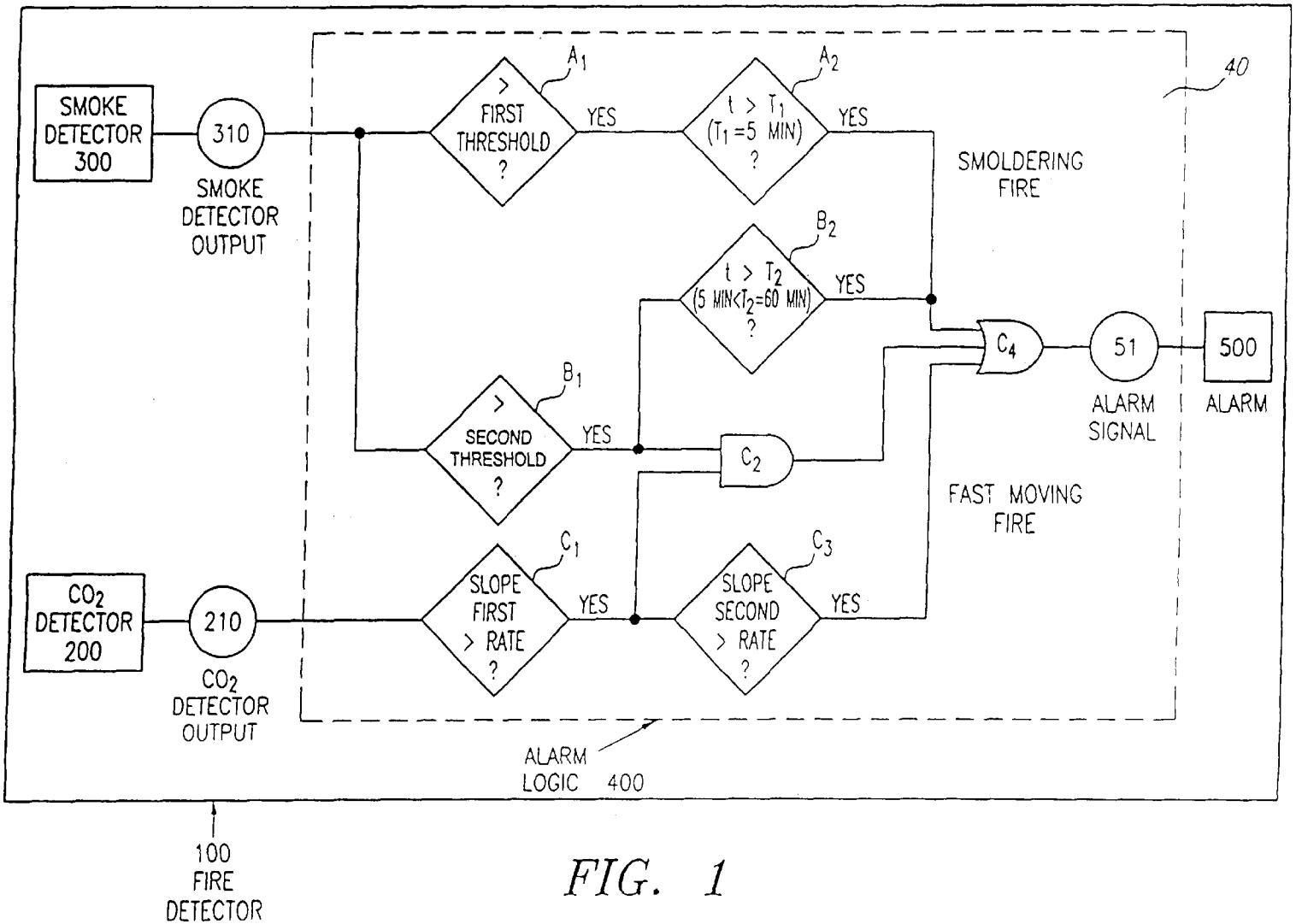
FIG. 1 is a flow diagram implementing the logic of a signal processor in accordance with the preferred embodiment of the present invention.

FIG. 1 is a flow diagram implementing alarm logic 400 of signal processor 40 shown in FIG. 2. The exact components that are used to accomplish the logical functions are not critical, nor are the pathways critical so long as the same data will lead to the same results. Thus, for example, OR gate $C_4$ could be replaced by multiple OR gates or other equivalent logic devices for accomplishing the same result. Similarly, although this diagram uses AND and OR gates, the AND and OR gates could all be replaced by decision boxes. Accordingly, use of AND and OR gates is not meant to be restrictive and is done solely for ease of comprehension and illustration.

As illustrated in FIG. 1, fire detector 100 generates an alarm signal 51 when any of four conditions are met. First, an alarm signal 51 will be generated if the output 310 from smoke detector 300 exceeds a threshold level $A_1$ for greater than a first preselected time $A_2$. Second, an alarm signal 51 will be generated if the output 310 from smoke detector 300 exceeds a reduced threshold level $B_1$ for greater than a second preselected time $B_2$. Third, an alarm signal 51 will be generated if the rate of increase in the concentration of $CO_2$ exceeds a first predetermined rate $C_1$ and light obscuration exceeds a reduced threshold $B_1$. Fourth, an alarm signal 51 will be generated if the rate of increase in the concentration of $CO_2$ exceeds a second predetermined rate $C_3$.

In order to decrease the maximum response time, the preferred embodiment relies upon a $CO_2$ detector to allow the fire detector to measure rate of increase in the concentration of $CO_2$. If the rate of increase exceeds a first predetermined rate $C_1$ and the smoke detector output 310 indicates that light obscuration also exceeds a reduced threshold level $B_1$ as indicated by the "AND" gate $C_2$, an alarm signal 51 is generated. Alternatively, if the $CO_2$ rate of increase exceeds a second predetermined rate $C_3$, an alarm signal is generated.

In accordance with the preferred embodiment, the first predetermined $CO_2$ rate of change $C_1$ is between approximately 150 ppm/min to approximately 250 ppm/min and the second predetermined $CO_2$ rate of change $C_3$ is approximately 1,000 ppm/min. The first predetermined rate of change was obtained based upon fire tests for paper, wood, gasoline and polystyrene fires performed in accordance with ANSI/UL 217—1985, Mar. 22, 1985 using an NDIR sensor in which the following averaged rates of change indicated a fire during each of the four tests: 300 ppm/min for the paper fire test; 150 ppm/min for the wood fire test; 250 ppm/min for the gasoline fire test; and 170 ppm/min for the polystyrene fire test. Using the foregoing rates of change to detect a fire, the averaged response time for detecting fires in each of these tests was 1.5 minutes.

Under normal circumstances, a first predetermined $CO_2$ rate of change between approximately 150 ppm/min to approximately 250 ppm/min should not trigger false alarms, absent a sudden, localized fluctuation measured by the $CO_2$ detector, because it is well above the rate of change that should be encountered assuming proper ventilation. In this regard, HVAC Standard 62-1989 for a confined space states that the maximum rate of increase of $CO_2$ should be between 30–50 ppm/min. Thus, even if ventilation is not in compliance with this standard, a rate of change of 150–250 ppm/min still leaves a margin of error to prevent false alarms.

However, there may be situations where there is faulty ventilation or where there is a sudden, localized fluctuation measured by the $CO_2$ detector. It is conceivable that the $CO_2$ sensor could detect a sudden, localized rate of change in the range of 150–250 ppm/min if it is located too near a potential source of $CO_2$, such as one or more persons exhaling directly into the $CO_2$ sensor. In order to prevent false alarms attributable to such unlikely situations, the fire detector logic of the preferred embodiment is configured such that an alarm signal will not be generated unless the rate of increase in the concentration of $CO_2$ exceeds the range of 150–250 ppm/min $C_1$ and light obscuration detected by the smoke detector exceeds a reduced threshold level $B_1$. With both of these conditions required in order to sound an alarm, the chance of false alarms is minimized. Because the reduced light obscuration threshold can be set well below current thresholds being used in smoke detectors designed for home use and still function as an inhibitor of a false alarm, the maximum response time is still significantly less than that of current smoke detectors. This is so because the reduced threshold is not being used in this application as an indication of a fire per se. Instead, it is being used as a test of the accuracy of the fire indication attributable to the $CO_2$ detector. Thus, the reduced threshold is set at a rate that is lower than that which would be acceptable in a smoke detector by itself (because it would be too susceptible to false alarms). But, since light obscuration above the reduced threshold will not trigger an alarm signal absent a rate of change of $CO_2$ concentration which exceeds the first predetermined rate, false alarms attributable solely to the reduced threshold will not be imparted to the fire detector. As a result, if a rate of change of between approximately 150 to approximately 250 ppm/min is used as the first predetermined rate, the maximum average response time to detect a fire under each of the paper, wood, gasoline and polystyrene tests of ANSI/UL 217—1985, Mar. 22, 1985 can still be less than 1.5 minutes, and in some instances actually less than 1 minute.

If the rate of change of $CO_2$ exceeds the second predetermined rate, it is unlikely that such a change would not be caused by a fire assuming that the second predetermined rate is set high enough, that the fire detector is correctly positioned and that there is no intentional attempt to set off the fire detector (such as a person deliberately and rapidly exhaling directly on the fire detector). Moreover, even if there is no fire, such an alarm will not be wasted because it can still identify a potentially dangerous condition that needs immediate attention. By including this option in the fire detector logic, the preferred embodiment detects fires with a very high rate of change in the concentration of $CO_2$, indicative of a fast moving type of fire, earlier. In addition, this option helps to avoid problems inherently associated with smoke detectors, such as the criticality of their placement, because $CO_2$ gas molecules diffuse much faster than smoke particles.

Although a $CO_2$ detector is very good in rapidly detecting fires, it is not very good in detecting smoldering fires in accordance with the test set forth in paragraph 43 of ANSI/UL 217—1985, Mar. 22, 1985. In a smoldering fire test performed in accordance with ANSI/UL 217—1985, Mar. 22, 1985 using an NDIR sensor, it was found that the rate of change of $CO_2$ concentration that had to be detected to detect a smoldering fire was approximately 10 ppm/min. Unfortunately, this rate of change is too low to be very useful in the types of applications covered by ANSI/UL 217—1985, Mar. 22, 1985 (such as household smoke detectors) because such a rate of change is below the acceptable rate of increase that can be encountered under normal conditions and thus would be subject to false alarms.

In order to detect smoldering fires, the preferred embodiment includes a smoke detector to detect smoldering fires when light obscuration exceeds a smoldering fire detection level for greater than a preselected time. This can be accomplished in one of two ways. First, if light obscuration exceeds a threshold level $A_1$ for greater than a first preselected time $A_2$. Second, if light obscuration exceeds a reduced threshold level $B_1$ for greater than a second preselected time $B_2$.

The first option for detecting smoldering fires relies upon a threshold level of obscuration that would detect wood, paper, gasoline or polystyrene fires in accordance with ANSI/UL 217—1985, Mar. 22, 1985 and still minimize false alarms but avoids the problem of false alarms by suppressing the alarm until a sufficient time has passed to rule out the possibility of a false alarm. In a preferred embodiment, the threshold level is the ANSI/UL 217—1985, Mar. 22, 1985 threshold level, which originally was approximately 7%, and the first preselected time is five minutes.

The second option for detecting smoldering fires relies upon a reduced threshold level of obscuration that is less than the threshold level and a second preselected time that is greater than the first preselected time. In this option, lower levels of obscuration are detected, but false alarms are avoided by requiring this condition to be met for a longer period of time. In a preferred embodiment, the reduced threshold level is substantially less than 7% and the second preselected time is greater than five minutes but less than sixty minutes. In selecting the reduced threshold level, the reduced threshold level should not be set so low that it will produce false alarms due to the inherent sensitivity of the smoke detector; accordingly, the sensitivity of the smoke detector will establish a minimum beneath which the reduced threshold should not be set. In selecting a reduced threshold level above this minimum, empirical test data can be used to optimize the desired results.

Further, the first and the second options for detecting smoldering fires can both be used in the same fire detector to optimize results as is shown in FIG. 1. The signal processor could use alarm logic to trigger an alarm signal when either the first or the second option is met. Thus, for example, the threshold level could be set at approximately 7%, the reduced threshold level could be set at substantially less than 7%, the first preselected time could be set at 5 minutes and the second preselected time could be set greater than 5 minutes but less than 60 minutes.

In accordance with a preferred embodiment, it is now possible to construct a fire detector that will meet ANSI/UL 217—1985, Mar. 22, 1985, including the smoldering fire test, and also trigger an alarm within a maximum average response time of approximately 1.5 minutes when subjected to Tests A–D described in paragraphs 42.3–42.6 of ANSI/UL 217—1985, Mar. 22, 1985.

In another aspect of the present invention, it is possible to build a fire detector with a very fast maximum response time in which a $CO_2$ detector is used to detect fires and a smoke detector is used to prevent false alarms. In this embodiment, alarm logic 4A does not use the output 310 from the smoke detector 300 to detect smoldering fires; instead, it is used solely as a test of the accuracy of the fire indication attributable to the $CO_2$ detector. Although this embodiment is not as preferred as the preferred embodiment already described, it still represents a significant advance over the state of the art and FIG. 3 illustrates such a fire detector.

Figure 3:
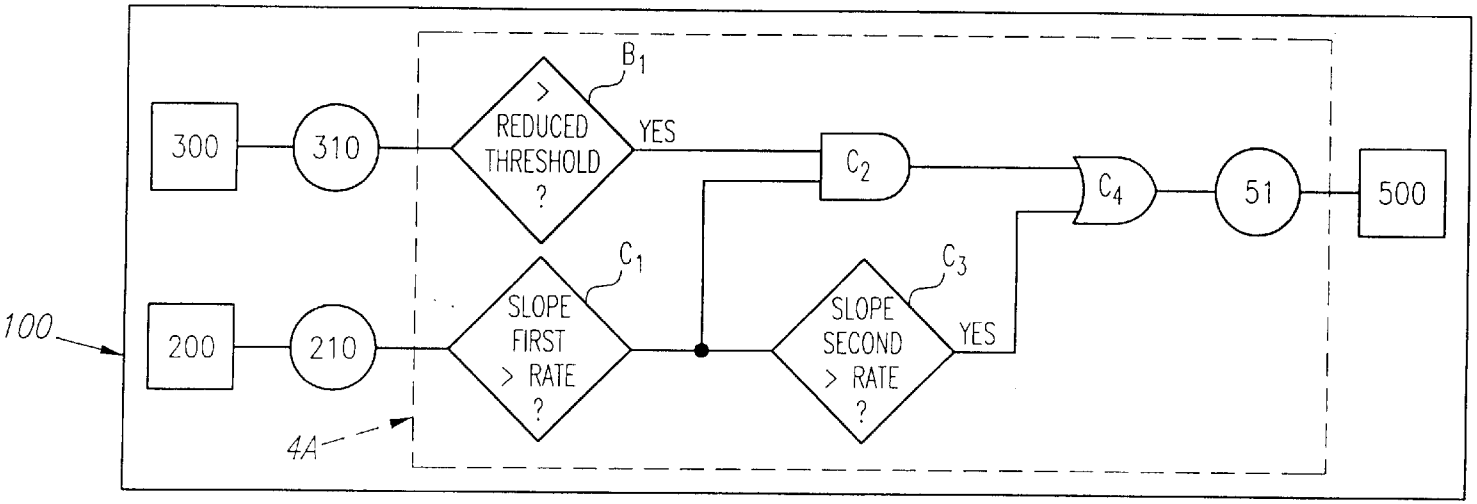
FIG. 3 is a flow diagram implementing the logic of a signal processor in accordance with an alternative embodiment of the present invention.

As illustrated in FIG. 3, fire detector 100 generates an alarm signal 51 when either of two conditions are met. First, an alarm signal 51 will be generated if the rate of increase in the concentration of $CO_2$ exceeds a first predetermined rate $C_1$ and light obscuration exceeds a reduced threshold $B_1$. Second, an alarm signal 51 will be generated if the rate of increase in the concentration of $CO_2$ exceeds a second predetermined rate $C_3$.

As for the actual construction of a fire detector in accordance with the principles of the present invention, the components of the fire detector can be contained in a single package; alternatively, and less preferably, the individual components need not be contained in a single package. The fire detector can contain an alarm that is audible or visual or both; alternatively, the fire detector can generate an alarm signal that is transferred to a separate alarm or an alarm signal can be used in any suitable device to trigger an alarm response or indication.

The $CO_2$ detector is preferably an NDIR gas detector. Suitable NDIR detectors could incorporate the teachings of NDIR detectors disclosed in U.S. Pat. No. 5.026,992 to Jacob Y. Wong entitled "Spectral Rationing Technique for NDIR Gas Analysis" or U.S. Pat. No. 5,341,214 to Jacob Y. Wong entitled "NDIR Gas Analysis Using Spectral Rationing Technique," the disclosures of which are specifically incorporated herein by reference. For those $CO_2$ detectors used to measure $CO_2$ concentration levels in PPM's, from which the $CO_2$ rate of change is derived, they should be stable and capable of accurate detection over long periods of time. To insure accuracy and reliability, drift of this type of $CO_2$ detetctors should preferably limited to less than approximately 50 ppm/5 years.

A simpler type of NDIR $CO_2$ detector that can be used is disclosed in U.S. Pat. No. 5,163,332 to Jacob Y. Wong entitled "Improved Gas Sample Chamber" the disclosure of which is specifically incorporated herein by reference. This patent discloses an NDIR $CO_2$ detector whose output is directly indicative of and proportional to the $CO_2$ rate of change. This type of so-called "single beam" NDIR gas detector is simpler, and hence easier, to implement and is consequently among the lowest cost of NDIR gas sensors.

The smoke detector can be an ionization type detector, but a photoelectric type of smoke detector is preferred. Further, in an especially preferred embodiment, the smoke detector can conveniently and economically be combined with a $CO_2$ detector in a single detection device as described in a related patent application filed concurrently herewith by Jacob Y. Wong entitled "A Practical Improved Fire Detector", the disclosure of which is specifically incorporated herein by reference.

Figure 4:
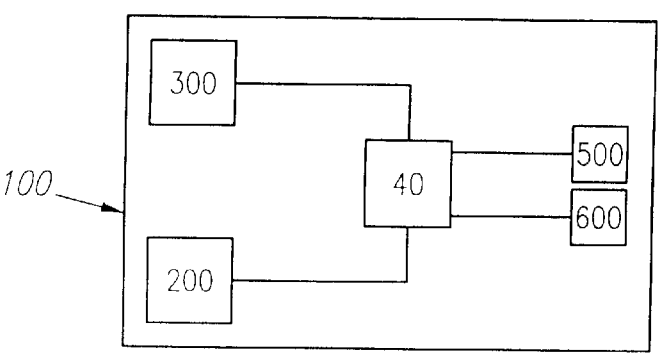
FIG. 4 is a block diagram for another alternative embodiment of the present invention.

The above discussion of this invention is directed primarily to the preferred embodiment and practices thereof. Further modifications are also possible in alternative embodiments without departing from the inventive concept. Thus, for example, the fire detector can be constructed so as to be programmable for different functions or to meet different requirements. In such a fire detector, any or all of the following can be programmable: the threshold level and the first preselected time, the reduced threshold level and the second preselected time, the first predetermined rate of change or the second predetermined rate of change. In another modification of the preferred embodiment, the fire detector logic can be altered to provide a first reduced threshold used to generate an alarm signal for the purpose of detecting a smoldering fire and a second reduced threshold used as a test of the accuracy of the fire indication attributable to the $CO_2$ detected. In still another modification of the preferred embodiment, a different alarm or alarm signal can be generated for different types of fires. Such a detector is depicted in FIG. 4 in which fire detector 100 contains a $CO_2$ detector 200, a smoke detector 300, a signal processor 40, a fire alarm 500 and a smoldering fire alarm 600. Of course, the same result could be obtained by using fire alarm 500 to produce different alarms depending upon the type of fire.

Accordingly, it will be readily apparent to those skilled in the art that still further changes and modifications in the actual concepts described herein can readily be made without departing from the spirit and scope of the invention as defined by the following claims.

What is claimed is:

1. A fire detector, comprising:

a smoke detector that generates a smoke detector output signal representative of light obscuration;

a carbon dioxide ("$CO_2$") detector that generates an output signal representative of $CO_2$ concentration; and a signal processor which receives the smoke detector output signal and the $CO_2$ detector output signal and generates an alarm signal when either of the following criteria is met:

light obscuration exceeds a smoldering fire detection level for greater than a preselected time; or light obscuration exceeds a reduced threshold level and the rate of increase in the concentration of $CO_2$ exceeds a first predetermined rate.

2. A fire detector as recited in claim 1, wherein the smoldering fire detection level is exceeded when light obscuration exceeds a threshold level for greater than a first preselected time.

3. A fire detector as recited in claim 2, wherein the threshold level is approximately 7%.

4. A fire detector as recited in claim 3, wherein the first preselected time is five minutes.

5. A fire detector as recited in claim 1, wherein the smoldering fire detection level is exceeded when light obscuration exceeds a reduced threshold level for greater than a second preselected time.

6. A fire detector as recited in claim 5, wherein the reduced threshold level is substantially less than 7%.

7. A fire detector as recited in claim 6, wherein the second preselected time is greater than five minutes but not greater than sixty minutes.

8. A fire detector as recited in claim 1, wherein the smoldering fire detection level is exceeded when light obscuration exceeds a threshold level for greater than a first preselected time or when light obscuration exceeds a reduced threshold level for greater than a second preselected time.

9. A fire detector as recited in claim 8, wherein the threshold level is approximately 7%, the reduced threshold level is substantially less than 7%, the first preselected time is approximately 5 minutes or more and the second preselected time is greater than the first preselected time but not greater than sixty minutes.

10. A fire detector as recited in claim 8, wherein the signal processor will also trigger an alarm when the rate of increase in the concentration of $CO_2$ exceeds a second predetermined rate.

11. A fire detector as recited in claim 1, wherein the $CO_2$ detector is an NDIR gas sensor.

12. A fire detector as recited in claim 1, wherein the first predetermined rate is between approximately 150 to approximately 250 ppm/min.

13. A fire detector as recited in claim 1, wherein the signal processor will also trigger an alarm if the light obscuration exceeds the threshold level and the rate of increase in the concentration of $CO_2$ exceeds the first predetermined rate.

14. A fire detector as recited in claim 1, wherein the fire detector will meet ANSI/UL 217—1985, Mar. 22, 1985 and also trigger an alarm within a maximum average response time of approximately 1.5 minutes when subjected to Tests A–D described in paragraphs 42.3–42.6 of ANSI/UL 217—1985, Mar. 22, 1985.

15. A fire detector as recited in claim 1, wherein the output signal generated by the $CO_2$ detector is representative of $CO_2$ concentration.

16. A fire detector as recited in claim 15, wherein the $CO_2$ detector has a drift of less than approximately 50 ppm/5 years.

17. A fire detector as recited in claim 1, wherein the smoke detector is a photoelectric smoke detector.

18. A fire detector as recited in claim 1, wherein the signal processor will also trigger an alarm when the rate of increase in the concentration of $CO_2$ exceeds a second predetermined rate.

19. A fire detector as recited in claim 18, wherein the second predetermined rate is approximately 1000 ppm/min.

20. A fire detector as recited in claim 18, wherein the first predetermined rate is between approximately 150 to approximately 250 ppm/min.

21. A fire detector as recited in claim 18, wherein the fire detector will meet ANSI/UL 217—1985, Mar. 22, 1985 and also trigger an alarm within a maximum average response time of approximately 1.5 minutes when subjected to Tests A–D described in paragraphs 42.3–42.6 of ANSI/UL 217—1985, Mar. 22, 1985.

22. A fire detector as recited in claim 1, wherein a smoldering fire causes a smoldering fire alarm signal to be triggered whereas a non-smoldering fire causes a non-smoldering alarm signal to be triggered.

23. A fire detector, comprising:

a smoke detector that generates a smoke detector output signal representative of light obscuration;

a ("$CO_2$") detector that generates an output signal representative of $CO_2$ concentration; and a signal processor which receives the smoke detector output signal and the $CO_2$ detector output signal and generates an alarm signal when either of the following criteria is met:

light obscuration exceeds a reduced threshold level and the rate of increase in the concentration of $CO_2$ exceeds a first predetermined rate; or the rate of increase in the concentration of $CO_2$ exceeds a second predetermined rate.

24. A fire detector as recited in claim 23, wherein the first predetermined rate is between approximately 150 ppm/min and approximately 250 ppm/min and the second predetermined rate is greater than approximately 1,000 ppm/min.

25. A fire detector as recited in claim 23, wherein the fire detector will meet ANSI/UL 217—1985, Mar. 22, 1985 and also trigger an alarm within a maximum average response time of approximately 1.5 minutes when subjected to Tests A–D described in paragraphs 42.3–42.6 of ANSI/UL 217—1985, Mar. 22, 1985.

26. A fire detector as recited in claim 23, wherein the output signal generated by the $CO_2$ detector is representative of $CO_2$ concentration.

27. A fire detector as recited in claim 26, wherein the $CO_2$ detector has a drift of less than approximately 50 ppm/5 years.

28. A fire detection logic system, comprising:

a first logic path for determining if a first input signal representative of light obscuration exceeeds a smoldering detection level for greater than a preselected time;

a second logic path for determining the rate of increase in the concentration of carbon dioxide ("$CO_2$") from a second input signal representative of the rate of change of $CO_2$ concentration; and a logic device for generating an alarm signal when either of the following criteria is met:

light obscuration exceeds the smoldering fire detection level for greater than the preselected time; or light obscuration exceeds the reduced threshold level and the rate of increase in the concentration of $CO_2$ exceeds the first predetermined rate.

* * * * *